United States Patent [19]

Itoh et al.

[11] Patent Number: 4,464,846

[45] Date of Patent: Aug. 14, 1984

[54] HYDRO-EXTRACTING APPARATUS FOR CHEESES OF YARN

[75] Inventors: Takeji Itoh, Aichi; Nobutaka Ono, Hyogo, both of Japan

[73] Assignee: Osaka Bobbin Kabushiki Kaisha, Osaka, Japan

[21] Appl. No.: 397,941

[22] Filed: Jul. 13, 1982

[30] Foreign Application Priority Data

Jul. 17, 1981 [JP] Japan ..... 56-112738

[51] Int. Cl.[3] ..... F26B 11/08

[52] U.S. Cl. ..... 34/58; 34/105; 414/223; 414/225

[58] Field of Search ..... 99/452, 453, 456, 458, 99/459, 460, 466; 426/491, 582, 495; 494/42, 60; 210/360.1, 361, 369; 414/222, 223, 225, 226; 34/8, 58, 105

[56] References Cited

U.S. PATENT DOCUMENTS

| | | | |
|---|---|---|---|
| 555,893 | 3/1896 | Andersson | 99/456 |
| 913,285 | 2/1909 | Harbeck | 34/105 |
| 2,341,211 | 2/1944 | Denyssen | 34/58 |
| 2,387,276 | 10/1945 | Link | 99/453 X |
| 2,414,837 | 1/1947 | Riggs | 426/491 |
| 2,432,829 | 12/1947 | Strezynski | 99/456 |
| 2,554,118 | 5/1951 | Moser | 414/223 X |
| 3,045,358 | 7/1962 | Breakell et al. | 34/105 |
| 3,058,230 | 10/1962 | Grether | 34/105 |
| 3,119,775 | 1/1964 | Wilsmann et al. | 99/456 X |
| 3,295,205 | 1/1967 | Sjoholm | 99/456 |

FOREIGN PATENT DOCUMENTS

| | | | |
|---|---|---|---|
| 2105021 | 3/1983 | United Kingdom | 34/58 |

*Primary Examiner*—Timothy F. Simone

*Attorney, Agent, or Firm*—Flynn, Thiel, Boutell & Tanis

[57] ABSTRACT

A hydro-extracting apparatus for drying cheeses of yarn comprises a rotary table having a plurality of spindles mounted thereon, on which spindles cheeses of dyed yarn are mounted vertically, a device for holding and conveying the cheeses one by one, which device includes a cheese lifting mechanism and a movable arm mechanism having chucks for engaging and releasing cheeses, this device being adapted for conveying cheeses one by one from the spindles of the rotary table to a hydro-extractor and, after hydro-extraction, to deliver the cheeses one by one to a cheese receiving unit, and a centrifugal hydro-extractor for hydro-extracting each of the cheeses, which hydro-extractor is laterally spaced apart from and adjacent to the foregoing device for conveying the cheeses. A flexible drive shaft and a spring are provided in the hydro-extractor to absorb vibrations, whereby hydro-extraction of dyed cheeses can be performed intermittently, consecutively and efficiently.

6 Claims, 3 Drawing Figures

HYDRO-EXTRACTING APPARATUS FOR CHEESES OF YARN

This invention relates to a centrifugal apparatus for efficiently hydro-extracting cheeses of yarn after dyeing without rotating them counter to their yarn winding directions.

Heretofore, hydro-extraction of dyed cheeses has been conducted by holding a plurality of cheeses at a time in a centrifugal hydro-extractor of a capacity sufficient to receive them, with the plurality of cheeses being placed within one hydro-extracting tub. These cheeses were usually stacked one upon another or arranged in radial positions in the tub.

However, a centrifugal hydro-extractor generally has, because of the centrifugal motion working from the center outwards, the inherent function that hydro-extraction is more easily performed in the outer portion of the hydro-extracting tub than in the inner portion of the tub near its center. Hence, there occurs an uneven hydro-extraction between the inner and outer portions. Where hot air is particularly admitted through the hydro-extractor from the center toward the outer portion, drying is more slowly performed in the outer portion. Moreover, where cheeses are arranged radially in the periphery of the hydro-extracting tub, hydro-extraction cannot be conducted in conformity with the yarn winding direction of the cheeses, thus causing disorder in yarn winding them. As a result, non-uniform hydro-extraction has been performed.

It is a considerably laborious task to introduce a number of cheeses amounting to 50 or so in number into the hydro-extracting tub at a time. It is also a waste of time to introduce them into the tub and to take them out of the tub. Therefore, diminution of the efficiency is unavoidable.

The hydro-extractor per se causes vibration upon high speed rotation, but few countermeasures have been adopted against it. As a result, winding disorder of cheeses has often taken place.

The present invention is designed to cope with and improve these prior art problems or drawbacks on hydro-extraction of dyed cheeses. Accordingly, an essential object of this invention is to provide a centrifugal hydro-extracting apparatus for cheeses capable of rationalizing the hydro-extraction of the dyed cheeses, thereby increasing the efficiency of hydro-extraction.

According to this invention, the centrifugal hydro-extracting apparatus for cheeses is constructed so that spindles each placed or mounted in a predetermined number of cheeses after dyeing are mounted on a rotary table, the cheeses are introduced one by one into a hydro-extractor wherein a flexible shaft and a spring are interposed between a hydro-extraction station and a driving station so as to dampen vibrations caused by imbalance of a cheese, the cheeses are one by one hydro-extracted by high speed revolution, and thereafter, the cheeses thus hydro-extracted are one by one again picked up and conveyed to a delivery device, such as other spindles for storage, mounted on another rotary table or a conveyor.

In order that the invention may be well understood, preferred embodiments thereof will be hereinafter described in more detail with reference to the accompanying drawings, in which.

Figure 1:
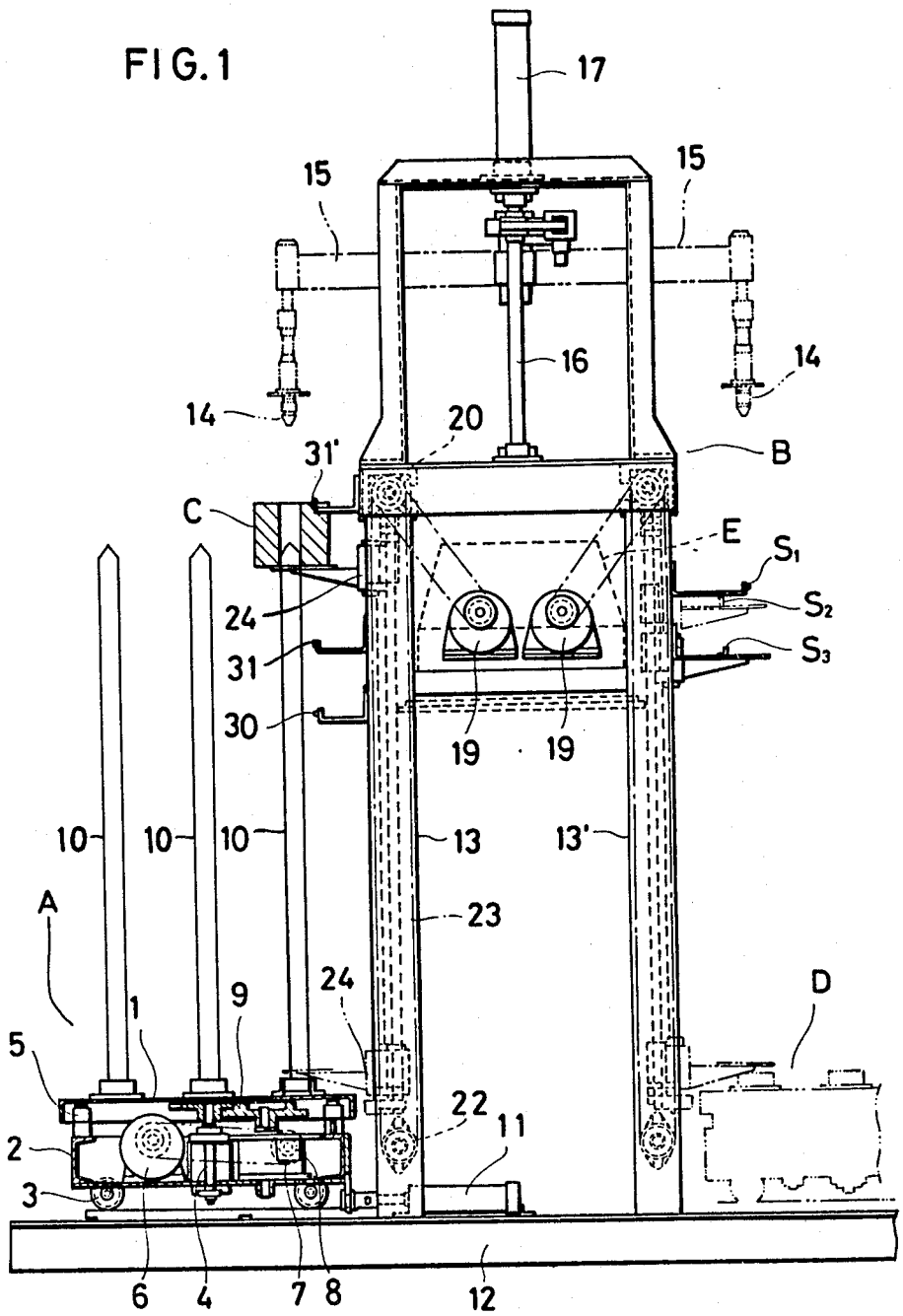
FIG. 1 is a schematic front elevational view showing one example of a centrifugal hydro-extracting apparatus of this invention.
Figure 2:
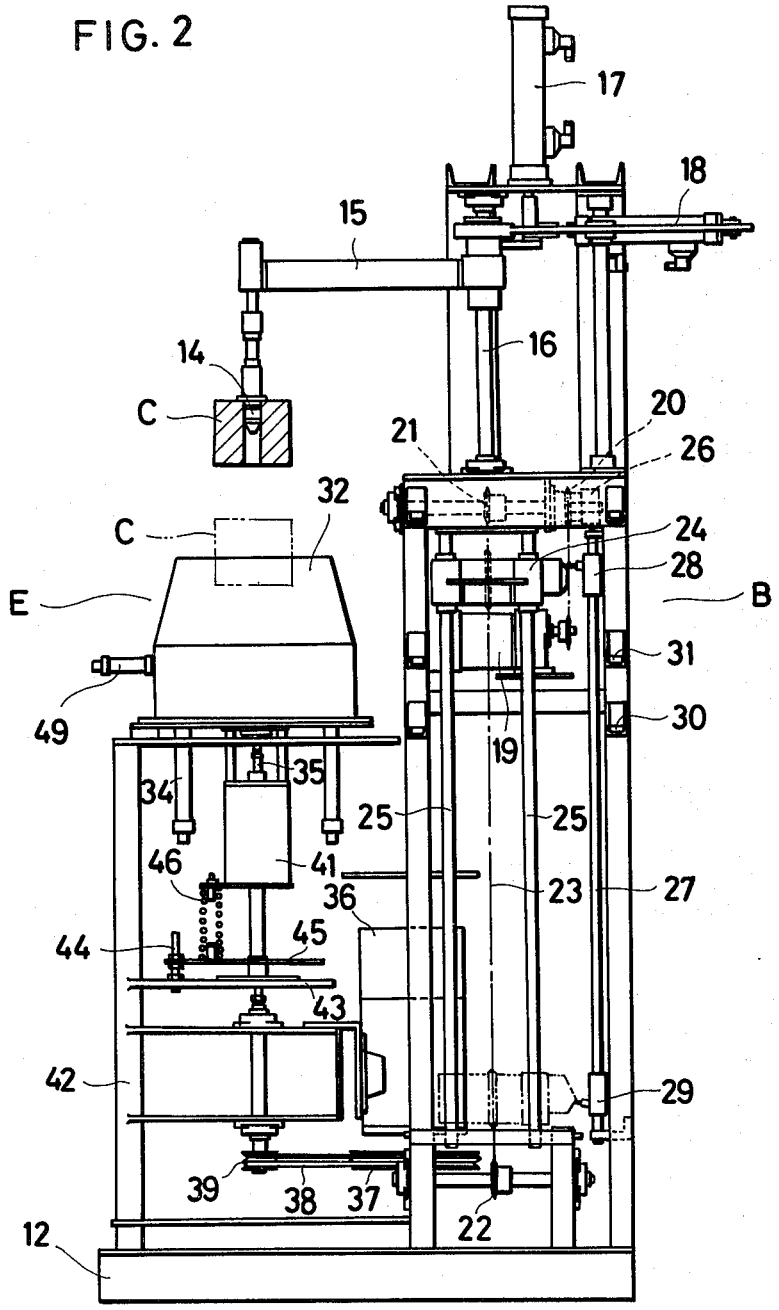
FIG. 2 is a schematic side elevational view of the apparatus shown in FIG. 1 with some parts omitted.
Figure 3:
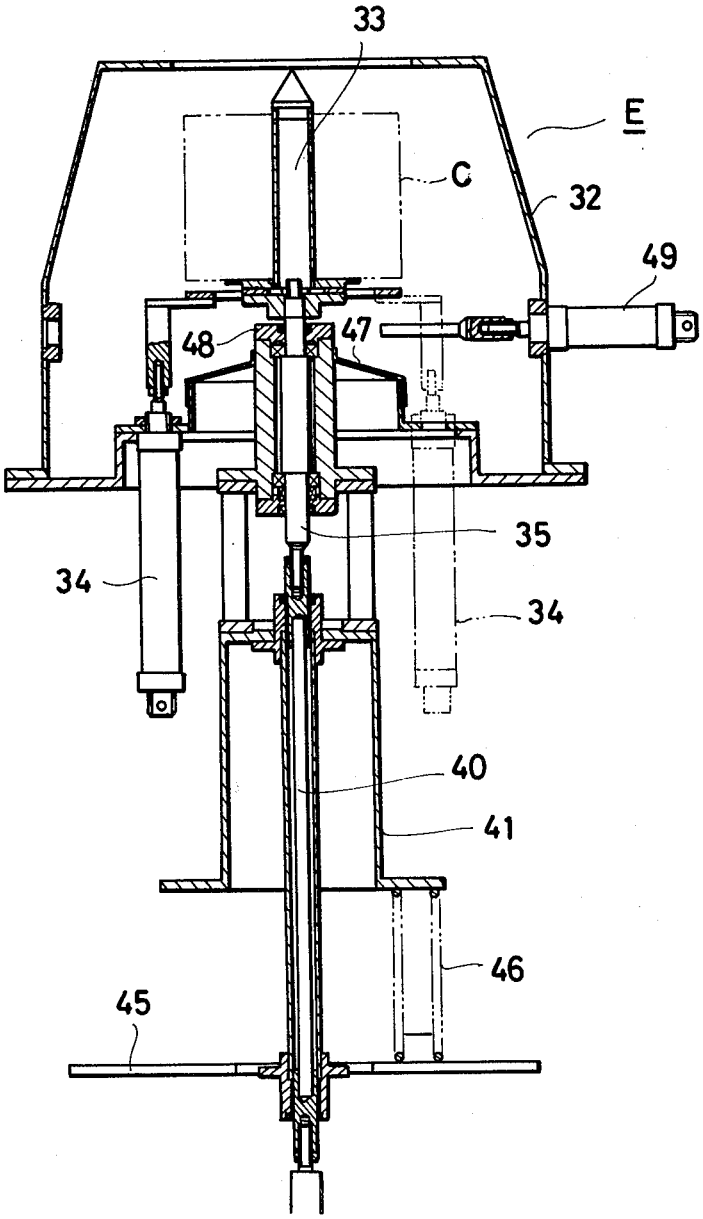
FIG. 3 is an illustration showing details of the inside of a hydro-extractor.

Referring to FIG. 1 to FIG. 3, there is shown one embodiment of the apparatus according to this invention which comprises a rotary table A on which spindles each mounted in dyed cheeses are adapted to rest vertically; a device B for holding and conveying cheeses C one by one, in which device the dyed cheeses C are one by one removed from each spindle at the working position and transferred to a hydro-extractor as described below, and after hydro-extraction of them one by one, the hydro-extracted cheeses are one by one taken out of the hydro-extractor for delivery to a device D such as another set of spindles for storage on another rotary table or a conveyor; and a centrifugal hydro-extractor E for hydro-extracting one by one the cheeses thus transferred, which is located to the side and adjacent to the foregoing cheese holding and conveying device B. The rotary table A, the cheese holding and conveying device B and the centrifugal hydro-extractor E thus constitute the essential elements of the apparatus.

Now, the respective elements will be described in detail, in turn.

Rotary Table A:

As shown in FIG. 1, a table plate 1 of the rotary table A is held in position above a main body 2 by means of a support member 5 at the top end of a support shaft 4 provided in the main body 2, to the underside of which mobile wheels 3 are attached.

When a motor 6 is driven, intermittent rotatory motions are imparted by means of a Geneva motion gear mechanism 9 through worm 8 of a reduction gear mechanism 7 connected through a transmission mechanism such as a chain to the motor 6. Concurrently with the intermittent motions, a plurality of spindles 10 mounted vertically on the rotary table A are, in turn, shifted to the working site.

In the previous dyeing process, the rotary table A provided with the mobile wheels 3 was located near a dyeing machine. After dyeing, the rotary table is moved from there, with dyed cheeses mounted and held on it, to the vicinity of the cheese holding and conveying device B. The working site is adjusted by means of air cylinder 11. The air cylinder 11 is also able to move the rotary table A outwardly along a workboard 12 by drawing a rod of the air cylinder out.

Cheese Holding and Conveying Device B:

The cheese holding and conveying device is provided with chucks 14 each for grasping cheeses one by one at a position above machine frames 13, 13' disposed diametrically side to side.

In the drawings, the chucks 14 are constructed to be rotatable at an angle within 180° as well as movable up and down through arms 15.

The chucks 14 are attached to the ends of the arms 15, of which a base end receives a guide 16 therein. The arms 15 are made so that it is possible to regulate their vertical position by an air cylinder 17 located above the guide 16 and are also made rotatable by means of an air cylinder 18 located sidewards. In this way, the chucks 14 are constructed to be capable of securely grasping, in turn, the cheeses C mounted with the spindle 10 therein at the working position above the rotary table A, one by one, when the cheeses are at the uppermost position of the spindle.

Alternatively, the chucks 14 may be reciprocated between the rotary table A and the delivery station D, instead of the rotatory motion as described above.

On the one side 13 of the transversely disposed machine frames 13, 13', a cheese lifting mechanism is further provided to lift the cheeses C placed or mounted on the spindle from the table A upwardly so that the cheeses may be readily grasped with the foregoing chucks 14.

The cheese lifting mechanism is formed of a lift 24 which serves to thrust the spindle from its underside and to lift the cheeses upwardly. The lift 24 is provided at a portion of a chain 23 engaged with and extending between a sprocket wheel 21, which revolves coaxially and integrally with a pulley 20 to which rotation is transmitted through a chain or belt from a motor 19 disposed in the median region of the device, and a sprocket wheel 22 on the lower side of the machine frame 13. In the drawings, the lift 24 is held in position where it is capable of ascending and descending along two guides 25.

The pulley 20 driven by the motor 19 and the sprocket wheel 21 are regulated appropriately as to their actuations by means of a cam clutch 26.

For ascending and descending motions of the lift 24 along the guides 25, a rod 27 is further provided in parallel with the guides, to which rod limit switches 28 and 29 are attached so as to determine the upper limit position and the lower limit position of the lift 24, respectively.

The above description was thus concerned with the one side of the machine frames for lifting cheeses C upwardly for the subsequent hydro-extraction as described below.

On the other hand, a similar mechanism is also provided on the other side 13' of the machine frames to that of the one side 13 as shown in the drawings. This mechanism is to deliver hydro-extracted cheeses C taken out of the hydro-extractor to a device D such as another rotary table for delivery having a similar construction to the above-described rotary table A or a conveyor for conveying the cheeses to the subsequent step, in an inverse manner to the above cheese-lifting movement.

The reference numerals 30, 31, $S_1$, $S_2$ and $S_3$ respectively indicate confirmation switches or photoelectric tubes for confirming the position of cheeses upon starting, the position of a spindle of one cheese blank, the position of a spindle received in a predetermined number of cheeses, the upper limit position of cheeses in the case of a spindle full of cheeses and the upper limit position of cheeses in the case of a spindle of one cheese blank.

Centrifugal Hydro-extractor E:

The centrifugal hydro-extractor E, as illustrated in detail in FIG. 2 and FIG. 3, is disposed sidewardly to the machine frames 13, 13' on the workboard 12, and is enveloped by a cover 32. Inside it, a rotary spindle 33 to be inserted in a cheese C is provided to be movable up and down, which cheese C is supported from three directions by means of air cylinders 34 for releasing each cheese.

The rotary spindle 33 rests on a supporting shaft 35 which is journaled in a bearing and extends downwards to where rotation is transmitted from a motor 36 enclosed by the machine frames 13, 13' through a pulley 37, a belt 38 and a pulley 39.

The downwardly extending portion of the supporting shaft 35 constitutes a flexible shaft 40 between the upper hydro-extraction station and the lower driving station.

Between the lower end of an outer sleeve 41 and a fixed plate 45 which is secured by means of a lock bolt 44 over a fixed stand 43 projecting from a machine frame 42, a spring 46 is further provided, whereby vibration caused by the eccentricity due to imbalance of a cheese is absorbed.

Usually, three or four springs 46 are provided.

The reference numeral 47 designates a rubber cover, the reference numeral 48 a brake wheel and the reference numeral 49 an air chuck.

Water produced within the hydro-extractor is drained appropriately through a drainage hose (not shown) from the bottom of the hydro-extraction tub enclosed by the cover 32.

Now, actuation and operation with the hydro-extracting apparatus of this invention as constructed above will be explained.

At first, when dyed cheeses C in a wet state mounted on the spindles 10 are conveyed to the rotary table A, the lift 24 positioned downwards is inserted beneath the lowermost portion of the spindle 10 at the working position to be ready for lifting the cheeses C upwardly and lifts the assembly of the spindle and cheeses upwardly.

As the cheeses C ascend, the chucks 14 positioned standing by and above the spindle are moved downwardly with the aid of the air cylinder 17 to grasp the lifted cheeses C one by one and release them from the spindle. Then, the chucks 14 again ascend by reason of the actuation of the air cylinder 17.

At this time, by means of the air cylinder 18 transversely disposed, the chucks 14 are turned by 90° through the arms 15, conveying the cheeses C one by one to the upside of the hydro-extractor E, from where the chucks 14 again move downwardly to introduce the cheeses C one by one into the hydro-extracting tub enclosed by the cover 32, in which one cheese is fitted on the spindle 33.

Then, hydro-extraction is conducted in usual manner by rotatory driving as required. Upon this centrifugal hydro-extracting, even if there is eccentricity due to imbalanced cheese and if, because of this, vibration occurs, the vibration can be absorbed by the flexible shaft 40 and the spring 46, whereby uniform and rapid hydro-extraction is achieved.

In this way, hydro-extraction is performed during a required period of time and is finished.

Thereafter, the hydro-extracted cheeses C inside the hydro-extracting tub are, inversely to the above operation, moved upwardly by means of the air cylinder 34 and are ready for delivery. The chucks 14 again descend and grasp the cheeses C within the cover 32.

Ascending in the grasping state, the chucks 14 are again turned in the opposite direction to the foregoing lifting side by 90° by means of the air cylinder 18 and release the hydro-extracted cheeses.

At the lower station for releasing, in case where a similar rotary table to the rotary table A is arranged, on which spindles are likewise mounted vertically, the cheeses C are delivered for fitting on the spindles by the reverse operation to the foregoing lifting operation. Where a conveyor is arranged there instead of the rotary table, they are delivered onto the conveyor without requiring any spindle.

Thus one cycle of hydro-extraction process operations is completed.

After the completion of one cycle of operations, the chucks 14 are turned and returned to the rotary table A at the initial station and again, a series of the cheese lifting, chuck turning, hydro-extracting and delivery operations are likewise conducted.

During these operations, when a predetermined number of cheeses C mounted and fitted on one spindle on the rotary table A have been lifted up with the ascending of the lift 24 and have been grasped with the chucks 14, then the rotary table A is turned to place the next spindle into the working site by means of its intermittent driving mechanism, and the same operations are repeated.

Thus, hydro-extraction as required is conducted intermittently, consecutively to cheeses one by one with a good efficiency. Usually, it takes about one minute to conduct the whole hydro-extraction process of one cheese.

In the hydro-extractor, it is preferred, from the viewpoint of efficiency, to make the weight of non-rotatory portions vibrating together with the cheese within five-fold of the weight of the dyed cheese.

As thus far described, according to the apparatus of this invention, dyed cheeses in the state of being mounted on spindles are mounted on the rotary table, are grasped up one by one and are hydro-extracted one by one by high speed rotation, so that there is no danger of hydro-extraction opposite to the yarn winding direction of the cheeses, as is the case with prior art hydro-extraction of cheeses. Since hydro-extraction can be thus conducted without running counter to the yarn winding direction, any adverse effect upon yarns can be avoided.

Troublesome labour for loading a number of cheeses into a hydro-extractor as in the prior art is no longer required, and automatic holding and hydro-extraction of cheeses can be efficiently performed.

Particularly, in the prior art, in case where hot air is admitted through the hydro-extractor from the center, there was a disadvantage that the outer portion of the cheeses is dried more slowly. To the contrary, in accordance with the apparatus of this invention, where hot air is admitted water content at the outer portion of cheese is made small and accordingly, balanced, uniform hydro-extraction is possible, so that uniform drying can be eventually attained.

Furthermore, since in the hydro-extractor, the flexible shaft and spring are interposed between the hydro-extracting station and driving station, not only is absorption of vibration possible, but also disorder of yarns upon rotation is inhibited by automatic centripetal action of the two elements, which assists in enhancing the quality of yarns. Again, a series of hydro-extraction operations can be easily performed, and rationalization of that process can be attained.

What is claimed is:

1. A hydro-extracting apparatus for drying cheeses of yarn by intermittently and consecutively hydro-extracting the cheeses, comprising:

a rotary table having means for supporting a plurality of spindles in upright, spaced-apart relationship thereon, the cheeses to undergo hydro-extraction being vertically mountable on the spindles, and means for effecting intermittent stepwise rotation of said table to thereby move said spindles in succession through a series of stations including an unloading station;

a vertically movable lifting device at said unloading station for lifting the cheeses, one by one, along the spindle at said unloading station to an elevated position thereon, and a movable arm mechanism movable laterally between said unloading station and a hydro-extraction station, cheese-holding means mounted on said arm mechanism for holding a cheese after it has been raised to the elevated position on a spindle at said unloading station, transferring the cheese from said unloading station to said hydro-extraction station and for releasing the cheese when said arm mechanism is at said hydro-extraction station;

a centrifugal hydro-extractor located at said hydro-extraction station and laterally spaced from said lifting device so that a cheese lifted from the spindle at said unloading station can be held, conveyed to and loaded into said hydro-extractor by said arm mechanism, said hydro-extractor including a hydro-extraction unit having a chamber into which the cheese is loaded by said arm mechanism, a driving mechanism, a flexible drive shaft which connects said driving mechanism to said hydro-extraction unit, said driving mechanism and said flexible drive shaft being effective to rotate said hydro-extraction unit to effect centrifugal hydro-extraction of the cheese, and a spring which resiliently engages said driving mechanism and said hydro-extraction unit, said spring and said flexible drive shaft being effective to absorb vibrations of said hydro-extraction unit caused by imbalance of the cheese within said hydro-extraction chamber; and a cheese receiving unit for receiving the cheese upon completion of hydro-extraction, said movable arm mechanism including means for unloading a cheese from said hydro-extraction unit, conveying said cheese to said cheese receiving unit and unloading said cheese on said cheese receiving unit.

2. An apparatus as claimed in claim 1, wherein said means for effecting intermittent rotation of said rotary table comprises a Geneva motion gear mechanism.

3. An apparatus as claimed in claim 1, wherein said lifting device comprises an upright guide member and a lift mounted on said guide member for upward and downward movement therealong, said lift being operable to engage a cheese mounted on the spindle at said unloading station and lift said cheese to the upper end of the spindle located at said unloading station.

4. An apparatus as claimed in claim 3, wherein said movable arm mechanism comprises a first air cylinder; a pair of rotatable arms connected to said first air cylinder, said first air cylinder being operable to adjust the vertical position of said arms; a pair of chucks mounted on each of said arms, which chucks are effective to engage and hold said cheeses; and a second air cylinder operable to rotate said arms around a common axis.

5. An apparatus as claimed in claim 4, wherein said hydro-extraction unit comprises a supporting shaft connected at the lower end thereof with said flexible shaft; a hydro-extraction tub; a rotary spindle connected to said support shaft and disposed within said tub, said rotary spindle being coaxial with said support shaft and said flexible shaft, said cheese being mounted on said rotary spindle during hydro-extraction; a brake for stopping rotation of said rotary spindle; and means for pushing said cheese upwardly off of said rotary spindle from the underside of said cheese.

6. A hydro-extracting apparatus for drying tubular cheeses of yarn, wherein the cheeses are supported on cheese-supporting spindles, comprising:

feed means for feeding cheeses to be hydro-extracted, a centrifugal hydro-extractor for receiving cheeses one at a time from said feed means and extracting liquid therefrom to dry them, discharge means for receiving the dried cheeses from said hydro-extractor and a movable transfer arm mechanism for moving cheeses from said feed means to said hydro-extractor and from said hydro-extractor to said discharge means;

said feed means comprising a horizontal rotary table having means for supporting a plurality of the cheese-supporting spindles thereon in upright, spaced-apart relationship, means for effecting intermittent stepwise rotation of said table thereby to move the cheese-supporting spindles successively through a series of stations including an unloading station, and a vertically movable lifting device at said unloading station for raising cheeses along a cheese-supporting spindle located at said unloading station to an elevated position;

said centrifugal hydro-extractor comprising a stationary cover having an upright rotatable hydro-extractor spindle therein for supporting and rotating a cheese to centrifugally extract liquid from the cheese, a driving mechanism for rotating said hydro-extractor spindle, said driving mechanism including a first stationary support, a second vertically movable support supporting said hydro-extractor spindle for vertical movement, resilient means positioned between said first and second supports whereby said second support is resiliently urged upwardly, and a shaft including a flexible shaft portion extending between said hydro-extractor spindle and said driving mechanism whereby said driving mechanism is capable of absorbing vibrations caused by an unbalanced cheese on said hydro-extractor spindle;

said movable arm mechanism including a first arm having a first chuck thereon for holding a cheese and a second arm having a second chuck thereon for holding a cheese, means supporting said arms for vertical movement and for pivoting movement about a vertical axis, means for moving said arm mechanism between a first position in which said first chuck is disposed above said lifting device and engages and holds a cheese that has been elevated on the cheese-supporting spindle at said unloading station and said second chuck engages and holds a dried cheese that has been hydro-extracted in said centrifugal hydro-extractor, and a second position in which said first chuck is disposed above said centrifugal hydro-extractor and places the cheese held thereby into said hydro-extractor and said second chuck is disposed above said discharge means and deposits the dried cheese carried thereby onto said discharge means.

* * * * *